US007084835B1

(12) United States Patent
McCormick et al.

(10) Patent No.: US 7,084,835 B1
(45) Date of Patent: Aug. 1, 2006

(54) COMPACT ANTENNA ASSEMBLY

(75) Inventors: Donald M. McCormick, Mt. Pleasant, SC (US); Ken A. Crawley, St. George, SC (US); Dean A. Glace, Summerville, SC (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/015,267

(22) Filed: Dec. 17, 2004

(51) Int. Cl.
*H01Q 1/12* (2006.01)

(52) U.S. Cl. ..... 343/890

(58) Field of Classification Search ..... 343/890, 343/891, 874, 752
See application file for complete search history.

(56) References Cited

U.S. PATENT DOCUMENTS

| | | | | |
|---|---|---|---|---|
| 2,724,052 | A | 11/1955 | Boyer | |
| 3,838,429 | A * | 9/1974 | Reggia | 343/750 |
| 3,967,276 | A | 6/1976 | Goubau | 343/752 |
| 4,201,989 | A * | 5/1980 | Czerwinski | 343/715 |
| 4,851,859 | A | 7/1989 | Rappaport | 343/790 |
| 5,155,495 | A | 10/1992 | Hately | 343/725 |
| 5,181,044 | A * | 1/1993 | Matsumoto et al. | 343/752 |
| 5,796,369 | A * | 8/1998 | Henf | 343/752 |
| 6,034,648 | A | 3/2000 | Hope | 343/790 |
| 6,642,902 | B1 | 11/2003 | Gustafson | 343/791 |
| 6,675,045 | B1 | 1/2004 | Mass | 607/32 |
| 6,795,023 | B1 * | 9/2004 | Chen | 343/700 MS |
| 6,806,835 | B1 | 10/2004 | Iwai | 343/702 |
| 6,836,247 | B1 * | 12/2004 | Soutiaguine et al. | 343/700 MS |

OTHER PUBLICATIONS

'How and Why It Works' [online]. Gap Antenna Products Corp., Aug. 15, 2001 [retrieved on Dec. 15, 2005]. Retrieved from the Internet: <URL: www.gapantenna.com/superc_how.htm>.

Alexander, W. C.. 'Is This AM Antenna for Real?'. Radio World [online], [retrieved on Dec. 15, 2005]. Retrieved form the Internet <URL: www.rexresearch.com/xfidant/xfidant.htm>.

* cited by examiner

*Primary Examiner*—Wilson Lee
*Assistant Examiner*—Angela M Lie
(74) *Attorney, Agent, or Firm*—J. Eric Anderson; Michael A. Kagan; Peter A. Lipovsky

(57) ABSTRACT

A compact antenna assembly which includes a lower member having a mast that is an elongated configuration terminating at an upper end and a lower end. The mast can be located at the center of an upper member. The upper member includes an emitter, having a perimeter, a top end, and a bottom end. The upper end of the mast is electrically connected to the perimeter near the top end. Furthermore, a collector with a centrally disposed opening can be placed in a horizontal plane which positions the collector orthogonally in space with respect to the mast so that the collector is electrically insulated from the emitter and the mast. The lower end of the mast is centered at the centrally disposed opening of the collector and extends perpendicularly to the plane of the collector.

26 Claims, 2 Drawing Sheets

COMPACT ANTENNA ASSEMBLY

BACKGROUND OF THE INVENTION

The Compact Antenna Assembly generally relates to low frequency (LF) and high frequency (HF) antennas, and more particularly, relates to low and high frequency vertical antennas used for the radiation and reception of various radio frequency (RF) signals.

These antennas are typically used by operators of radio and video equipment in military, private and amateur radio sectors to transmit, receive or transmit and receive information. The compact antenna assembly utilizes a structure which significantly reduces the height and footprint of the antenna as compared to traditional vertically polarized antennas. The compact antenna assembly also provides the user the option of mounting the antenna on a clamped pipe to an existing mast or on the ground or flat rooftop with restricted installation real estate.

Conventional vertically polarized antennas are operated at heights equivalent of ¼ of a wavelength and require a large number of ¼ or greater radial leads dispersed from the antenna on or under the ground to perform efficiently. Proper construction and installation of these conventional antennas may operate at near 100% efficiency but require a very tall antenna and a very large radial counterpoise area. Moreover, a tall antenna must have lights at various heights, including at the top of the antenna unit to warn approaching aircraft of the tall antenna structure which is difficult for pilots to see while in flight. Furthermore these tall antennas are obstacles which inhibit aircraft such as jets taking off or landing on an aircraft carrier.

Previously, the need for a shorter vertically polarized antenna was addressed by installation of a coil of wire called an inductor between the top and bottom of the shortened antenna. The inductor effectively replaces the missing section of the antenna by ineffectively lengthening the antenna. As the antenna is shortened the inductor increases in size which results in lower antenna efficiency due to greater power dissipated in the larger coil. A decrease in antenna efficiency reduces the capability of the antenna to radiate or receive signals.

Until now, antenna science and technology have been unable to produce a short antenna with small horizontal installation real estate requirements which could perform as efficiently as a conventional ¼ wavelength counterpart and very large real estate consumption counterpoise counterpart. Particularly, as the conventional ¼ wavelength antenna is shortened and the size of the coil is increased, the electric field produced by the shortened antenna decreases while the magnetic field wasted by the coil increases, reducing the conventional antenna efficiency and qualities of transmission or reception.

The significance of the size of the electric field surrounding the antenna is directly related to antenna efficiency and quality of transmission or reception. Therefore, conventional short antennas with smaller surrounding electric energy are not effective in transmission or reception of electric fields due to wasted magnetic energy lost in the coils required to shorten them.

When current flows in an antenna it creates a magnetic field, H, surrounding the conductor or coil. This same current flow also creates an electric field, difference of potential, or voltage, E, between the emitter and counterpoise or ground radial system. The H and E fields interact or "cross" each other creating electro(E)-magnetic(H) radiation. Maxwell's equations indicate that the electromagnetic radiation resulting from E×H will be proportional to the smaller of these two quantities that are inherently balanced. Thus, as the coil size increases to shorten the antenna length, the magnetic energy wasted by the coil increases, reducing the antenna H field and thereby reducing the electromagnetic radiation produced by E×H.

As the vertical antenna is shortened, the radiation resistance decreases while antenna current increases, thereby increasing the antenna magnetic field (H). However, as an even larger coil is inserted to shorten the conventional antenna, the magnetic (H) field losses reduce the difference of potential (E) or voltage present above the coil (at the antenna feed point) and the antenna radiation produced by E×H. Thus, conventional attempts to reduce the height and width of vertically polarized antennas have not been successful in maintaining the efficiency of conventional ¼ wavelength vertically polarized antennas.

Conventional science and technology acknowledge peak performance from tall antennas. Those seeking optimum antenna performance must therefore suffer the adverse height and real estate consumption required by the conventional ¼ wavelength antenna or suffer the degradation in efficiency resulting from the installation of a conventional shortened vertical antenna having significant electromagnetic (E×H) losses.

In summary, there is substantial need for an antenna which requires much less height and installation real estate than either the conventional ¼ wavelength or the inefficient shortened version of the conventional ¼ wavelength antenna. If this can be accomplished, both installation and maintenance costs will be significantly reduced. The requirements for long counterpoise radial systems and aircraft lighting beacons will be eliminated. The possibility to install compact and effective antennas in restricted areas will be available when magnetic field (H) losses can be eliminated from conventional vertically polarized antennas.

SUMMARY OF THE INVENTION

A compact antenna assembly which includes a lower member having a mast that is an elongated configuration terminating at an upper end and a lower end. The mast can be located at the center of an upper member. The upper member includes an emitter, having a perimeter, a top end, and a bottom end. The upper end of the mast is electrically connected to the perimeter near the top end. Furthermore, a collector with a centrally disposed opening can be placed in a horizontal plane which positions the collector orthogonally in space with respect to the mast so that the collector is electrically insulated from the emitter and the mast. The lower end of the mast is centered at the centrally disposed opening of the collector and extends perpendicularly to the plane of the collector.

DETAILED DESCRIPTION OF THE INVENTION

A compact antenna assembly 20 which exhibits a radical departure from the traditional ¼ wavelength antenna and respective area consuming counterpoise as well as an ineffective counterpart which is shortened by an ineffective inductive coil. This compact antenna assembly 20 can be sized for efficient operation from the extremely low frequency (ELF) through extremely high frequency (EHF) radio frequency bands.

Figure 1:
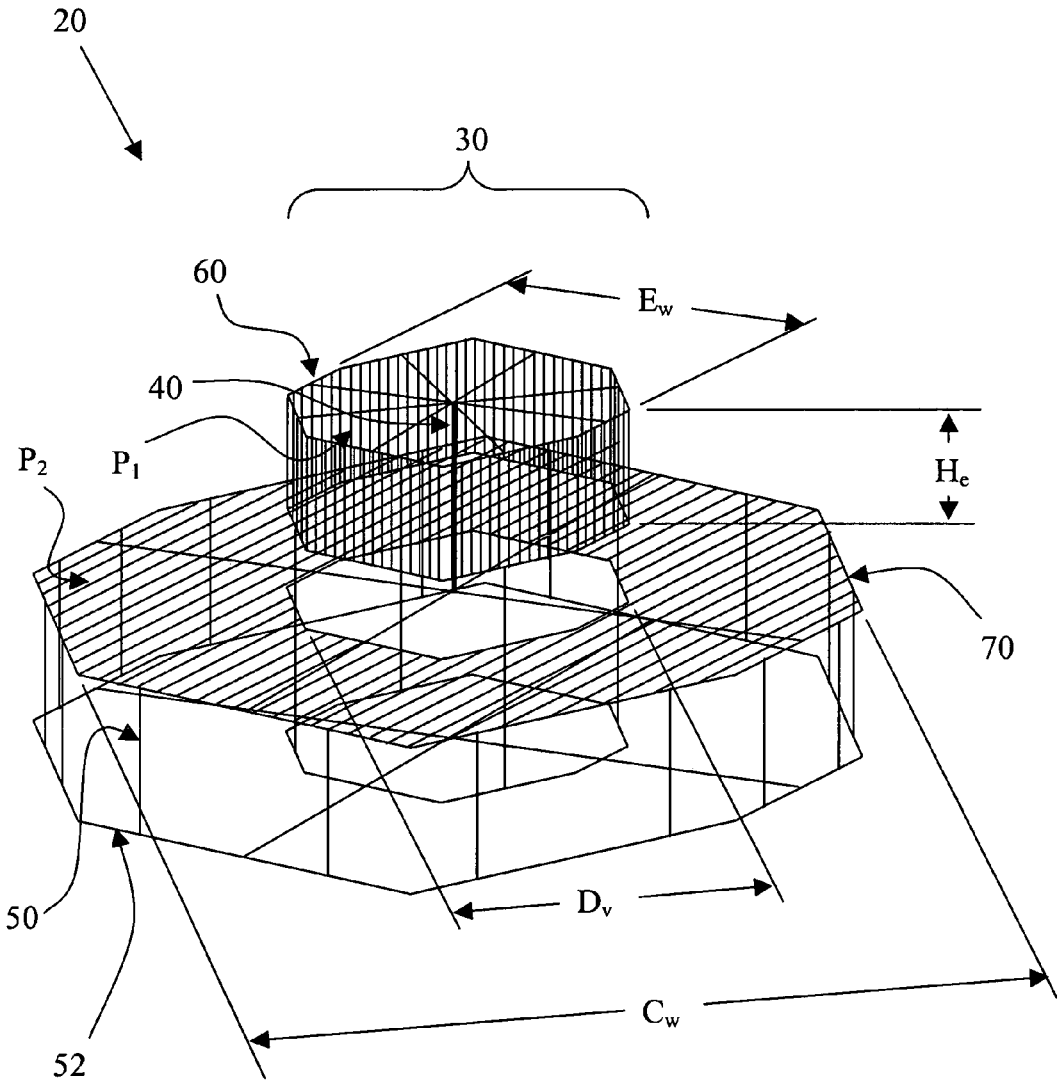
FIG. 1 is a perspective view of a version of a high efficiency compact antenna assembly, showing the component parts including the mast, emitter, collector and one version of a mount to raise the compact antenna assembly above ground.

One embodiment, as in FIG. 1, of a compact antenna assembly 20 may include an emitter 30 which may include a mast 40, a housing 60 and leads connecting the mast 40 to the housing 60 at the tops of both the mast 40 and the housing 60. The compact antenna assembly 20 may include a collector 70 which is displaced both physically and electrically from the emitter 30.

The collector 70 may include a horizontal substantially flat surface having a perimeter which is geometrically symmetric to the perimeter of the housing 60 of the emitter 30. For an omni-directional radiation or reception pattern, the collector 70 and emitter housing 60 may be constructed of a geometric shape such as but not limited to a circle, octagon, heptagon, hexagon, pentagon, square or triangle. By way of example, in FIG. 1, the collector 70 is shown to have a shape and the emitter 30 is shown to have an octagonal shape. For an omni-directional radiation or reception pattern, the emitter 30 may be centrally displaced within the opening or hole in the collector 70. To obtain a directional radiation or reception radiation pattern, the collector 70 or emitter 30 may be made irregular to one another and/or the collector opening or hole through which the emitter 30 is fed may be located at a non-central location on the collector 70.

The collector 70 may be constructed in a flat, horizontal fashion above the ground and can be supported by a vertical mount 50 or horizontal mount 52. The collector 70, however, may be connected directly to ground if necessary.

The compact antenna assembly may be such that the top of the emitter defines a plane $P_1$ and the top of the collector defines a plane $P_2$, and $P_1$ is parallel to $P_2$.

In one embodiment, the emitter 30 includes an upper member consisting of the mast 40, emitter housing 60 and coupling between the mast 40 and emitter housing 60 together with a lower member or collector 70 which is electrically and physically displaced from the upper member. In an embodiment which provides for an effective omni-directional vertically polarized radiation or reception pattern, the emitter housing 60 may be centrally connected to the top of the emitter 30 and may be electrically and physically displaced vertically and insulated from the collector 70 by at least about ⅛th the emitter height, $H_e$. The emitter housing perimeter may be significantly greater than that of the mast and significantly less than that of the perimeter of the collector. The emitter to mast height ratio may be in the range of about 1:1.2 to 1:1.5. The emitter perimeter may be equal to or greater than the perimeter of the opening or hole through which the mast is connected to an antenna tuner 72. When the diameter of the collector, $D_v$, opening is reduced, antenna gain and the antenna quality factor, Q, may increase and as the diameter of the collector opening, $D_v$, is increased, antenna gain and Q may decrease. Likewise, as the height of the emitter, $H_e$, is increased and the emitter width, $E_w$, is decreased, antenna Q may rise. As emitter height, $H_e$, decreases and width, $E_w$, increases, antenna Q decreases.

Figure 2:
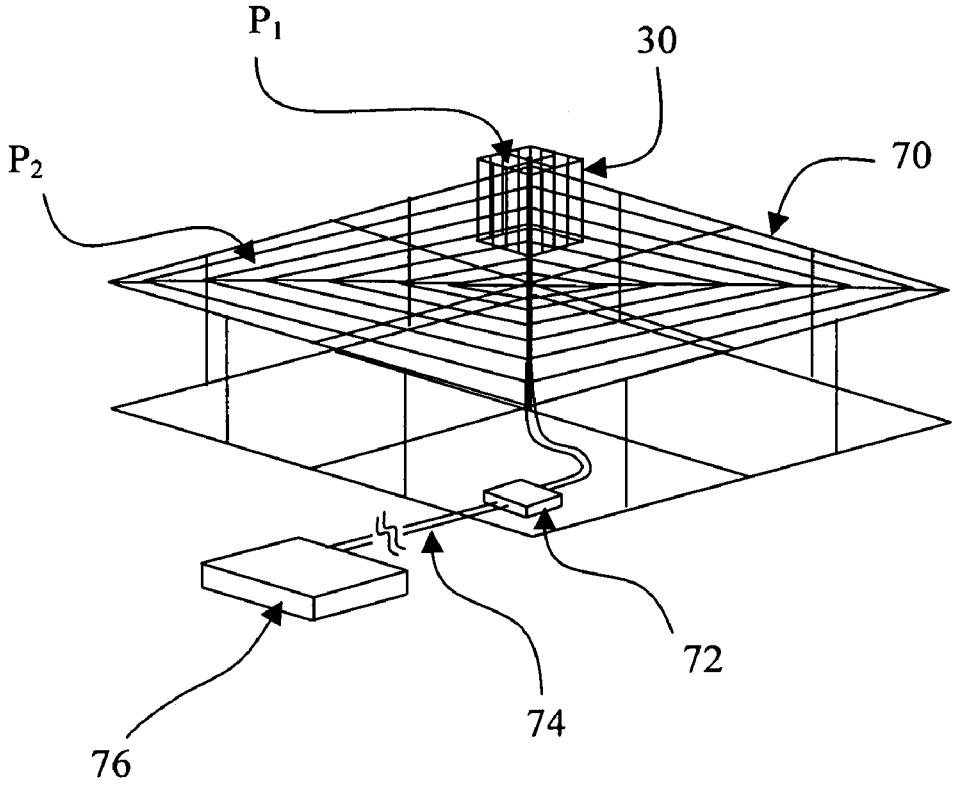
FIG. 2 is a perspective view of a version of a high efficiency compact antenna assembly showing electrical connections, wherein the perimeters of the emitter and collector are of similar symmetric geometric configuration.

The compact antenna assembly 20, as in FIG. 2, may be connected to signal interpretation equipment such as a transceiver 76, receiver or transmitter through an antenna tuner 72 via either 50 ohm, 75 ohm, 300 ohm or 600 ohm or other balanced or unbalanced feed lines 74.

Additionally, the collector 70 and emitter housing 60 may be formed of a mesh or screen in order to prevent snow, ice or water from collecting on the compact antenna assembly 20 during adverse weather conditions. The use of metallic screen is inexpensive, light to install and easy to maintain. A compact antenna assembly may be installed and replaced with ease. Wire mesh is somewhat more durable, but is heavier and significantly more costly to install or replace than is screen.

The inductive reactance of the compact antenna assembly may be established by the width of the short mast and the connection from the top of the mast to the top of the emitter.

As such, the surface area of the vertically oriented emitter 30 may be configured as required to meet the requirements of a particular application. In one embodiment of the compact antenna assembly 20 the emitter 30 and collector 70 areas may be related by area relationship ratios ranging from about 1:3 and 1:18. In another embodiment of the compact antenna assembly 20, the emitter and collector ratio may be about 1:3.1412 (pi), and the collector width, $C_w$, to emitter height, $E_h$, ratio may be about 1:3.1412 (pi). The relationship between emitter height, $E_h$, and the vertical distance, $D_v$, between the emitter 30 and collector 70 may be in the range of about 4:1 to 3:1.

We claim:

1. A compact antenna assembly, comprising:

(a) a lower member and an upper member wherein said lower member includes a mast, wherein said mast is an elongated configuration terminating at an upper end and a lower end, said mast located at the center of said upper member, wherein said upper member includes an emitter, said emitter includes a perimeter, a top end, and a bottom end, and said upper end of said mast is electrically connected to said perimeter near said top end;

(b) a collector, including a centrally disposed opening, disposed in a horizontal plane and orthogonally in space with respect to said mast, wherein said collector is electrically insulated from said emitter and said mast; and (c) wherein said lower end of said mast is centered at said centrally disposed opening of said collector and extends perpendicularly to said plane of said collector.

2. The compact antenna assembly of claim 1 wherein said perimeter is perpendicular to said top end and said bottom end.

3. The compact antenna assembly of claim 1 wherein said collector and emitter each have peripheries being the same shape.

4. The compact antenna assembly of claim 1 wherein the top of said emitter defines a plane $P_1$ and the top of said collector defines a plane $P_2$, wherein $P_1$ is parallel to $P_2$.

5. The compact antenna assembly of claim 1 further including a mounting device.

6. A compact antenna assembly, comprising:

(a) a lower member and an upper member wherein said lower member includes a mast, wherein said mast is an elongated configuration terminating at an upper end and a lower end, said mast located at the center of said upper member, wherein said upper member includes an emitter, said emitter includes a perimeter, a top end, and a bottom end, said perimeter is perpendicular to said top end and said bottom end, and said upper end of said mast is electrically connected to said perimeter near said top end;

(b) a collector disposed in a horizontal plane and including a centrally disposed opening thereby disposing said collector orthogonally in space with respect to said mast and electrically insulating said collector from said emitter and said mast;

(c) wherein said collector and emitter each have peripheries being the same shape;

(d) wherein said lower end of said mast is centered at said centrally disposed opening of said collector and extends perpendicularly to said plane of said collector; and (e) wherein said perimeter of said emitter is parallel to said mast and perpendicular to said plane of said collector.

7. The compact antenna assembly of claim 6 further including a charging means to supply a difference of potential to said collector.

8. The compact antenna assembly of claim 6 wherein said perimeter of said collector is greater than said perimeter of said emitter.

9. The compact antenna assembly of claim 6 wherein the ratio of the height of the mast relative to the height of the emitter ranges from about 1:1.25 to about 1:1.5.

10. The compact antenna assembly of claim 6 wherein said lower end of said mast includes an electrical contact point to connect said mast to a receiver.

11. The compact antenna assembly of claim 6 wherein said lower end of said mast includes an electrical contact point to connect said mast to a transmitter.

12. The compact antenna assembly of claim 6 wherein the width of the emitter is about equal to the width of the said centrally disposed opening of said collector.

13. The compact antenna assembly of claim 6 wherein the width of the emitter is greater than the width of the said centrally disposed opening of said collector.

14. The compact antenna assembly of claim 6 wherein the height of said emitter is about ⅙ to ½ the width of said emitter.

15. The compact antenna assembly of claim 6 wherein the height of said emitter is less than the width of said emitter.

16. The compact antenna assembly of claim 10 wherein said receiver includes a cable having a first cable end connected to said antenna assembly and second cable end connected to said receiver.

17. The compact antenna assembly of claim 16 wherein the hot side of said cable is insulated from the ground side.

18. The compact antenna assembly of claim 16 wherein an antenna tuner is disposed between the hot side and the ground side of said first cable end at the antenna.

19. A high efficiency compact antenna assembly comprising:

(a) a mast, an emitter, and a collector, wherein said collector has an opening;

(b) said mast is an elongated configuration terminating at an upper end and a lower end, wherein said upper end is electrically connected said emitter;

(c) said mast penetrates said opening and is insulated from said collector;

(d) said emitter has a geometrically regular symmetrical relationship and displacement from said collector;

(e) said collector is disposed in space orthogonally to said mast and said emitter;

(f) said emitter extending perpendicularly to and insulated from said collector; and (g) said emitter displaced from said collector and said opening to direct a radiated electric field in a vertically polarized, toroidal pattern.

20. The compact antenna assembly of claim 19 wherein said collector includes a width of about three times the width of said emitter.

21. The compact antenna assembly of claim 19 wherein the ratio of the height of said mast relative to the height of said emitter ranges from about 1:1.25 to about 1:1.5.

22. The compact antenna assembly of claim 19 wherein the perimeter of said emitter is connected to said upper end of said mast.

23. The compact antenna assembly of claim 19 wherein the perimeter of said emitter is about equal to said opening of said collector.

24. The compact antenna assembly of claim 19 wherein the perimeter of said emitter is greater than said opening of said collector.

25. The compact antenna assembly of claim 19 wherein the height of said antenna assembly is less than the width of said collector.

26. The compact antenna assembly of claim 19 further including a transmitting/receiving device and a tuning device connected to said antenna assembly wherefore said antenna assembly operates with frequencies of from about 1.6 to about 250 MHz.

* * * * *